US008882093B2

(12) United States Patent
Kuo

(10) Patent No.: US 8,882,093 B2
(45) Date of Patent: Nov. 11, 2014

(54) HANDHELD CLAMPING TOOL

(75) Inventor: Tzu-Chi Kuo, Keelung (TW)

(73) Assignee: Sheng Pu Promotion Co., Ltd., Xinbei (TW)

( * ) Notice: Subject to any disclaimer, the term of this patent is extended or adjusted under 35 U.S.C. 154(b) by 324 days.

(21) Appl. No.: 13/440,255

(22) Filed: Apr. 5, 2012

(65) Prior Publication Data

US 2013/0264758 A1 Oct. 10, 2013

(51) Int. Cl.
*B25B 5/06* (2006.01)

(52) U.S. Cl.
USPC ..... 269/6; 269/168; 269/171

(58) Field of Classification Search
USPC ..... 269/6, 166–171.5
See application file for complete search history.

(56) References Cited

U.S. PATENT DOCUMENTS

| | | | | |
|---|---|---|---|---|
| 6,945,523 | B2 * | 9/2005 | Degen | 269/90 |
| 7,513,492 | B1 * | 4/2009 | Kuo | 269/6 |
| 7,735,813 | B2 * | 6/2010 | Geier et al. | 269/6 |
| 8,424,856 | B2 * | 4/2013 | Lombardi et al. | 269/6 |
| 2006/0043660 | A1 * | 3/2006 | Ping | 269/6 |
| 2007/0194510 | A1 * | 8/2007 | Geler et al. | 269/6 |
| 2010/0156013 | A1 * | 6/2010 | Cicenas et al. | 269/6 |

* cited by examiner

*Primary Examiner* — Lee D Wilson
*Assistant Examiner* — Henry Hong
(74) *Attorney, Agent, or Firm* — Pai Patent & Trademark Law Firm; Chao-Chang David Pai

(57) ABSTRACT

A handheld clamping tool includes a sliding bar, a fixed handle having installed therein actuation plates, a stop plate, spring members and a release bar, a driving handle, a coupling rod coupling the actuation plates and the stop plate, and a first jaw holder. The driving handle has an integrated cam portion for driving the actuation plates and the stop plate. By means of the release bar, the handheld clamping tool can be quickly released.

3 Claims, 5 Drawing Sheets

HANDHELD CLAMPING TOOL

BACKGROUND OF THE INVENTION (a) Field of the Invention

The present invention relates to a handheld clamping tool and more particularly, to a simple design of handheld clamping tool, which uses a driving handle with an integrated cam portion for driving actuation plates and a release bar for releasing the reserved energy.

(b) Description of the Prior Art

Many clamping tools are known. U.S. Pat. No. 7,513,492 discloses a clamping tool, entitled "hand held quick-clamping device" and issued to the present inventor. This design of hand held quick-clamping device includes an adjusting rod, a retaining handle, a driving handle, a first clamping block, and a second clamping block. The adjusting rod intersects the retaining handle, a set of adjusting sheets, and the stop sheets. A first clamping block is locked in a predetermined end of an adjusting rod, and a second clamping block is formed on a top end of the retaining handle. A driving handle is pivoted to the retaining handle. A traveling top shaft is installed in the retaining handle, and an axial shaft is opposite to it. While the driving handle is pressed, a top end of the driving handle pushes the top shaft. Through the top shaft, the axial shaft pushes the adjusting sheets and the stop sheets. And the movement of the sheets will drive an adjusting rod to move in one direction, thus producing a clamping or extending function. This design of clamping tool is functional, however, it uses a large number of component parts, increasing the cost and complicating the installation. There is room for improvement.

Further, the holes of the adjusting sheets and stop sheets for the coupling of the adjusting rod are I-shaped holes. The adjusting rod may be moved up and down in the holes of the adjusting sheets and stop sheets, leading to false action and affecting normal clamping (or expanding) function.

SUMMARY OF THE INVENTION

The present invention has been accomplished under the circumstances in view. It is one object of the present invention to provide a handheld clamping tool, which has the advantages of simple structure and ease of installation.

To achieve this and other objects of the present invention, a handheld clamping tool comprises a sliding bar, a fixed handle having installed therein at least one actuation plate, a stop plate, a plurality of spring members and a release bar, a driving handle, a coupling rod coupling the at least one actuation plate and the stop plate, and a first jaw holder. The driving handle has an integrated cam portion for driving the actuation plates and the stop plate. By means of the release bar, the handheld clamping tool can be quickly released.

Further, the at least one actuation plate and the stop plate each define an inverted "T" hole. The coupling rod is a flat rod comprising two stepped broad end portions and a narrow elongated neck portion connected between the two stepped broad end portions.

The coupling rod is inserted through the inverted "T" holes of the at least one actuation plate and the stop plate, and then biased through 90° angle to have the stepped broad end portions thereof be respectively engaged in the respective bottom ends of the inverted "T" holes of the at least one actuation plate and the stop plate. Thus, the coupling rod is prohibited from vertical displacement relative to the at least one actuation plate and the stop plate, avoiding operational abnormality.

DETAILED DESCRIPTION OF THE PREFERRED EMBODIMENTS

Figure 1:
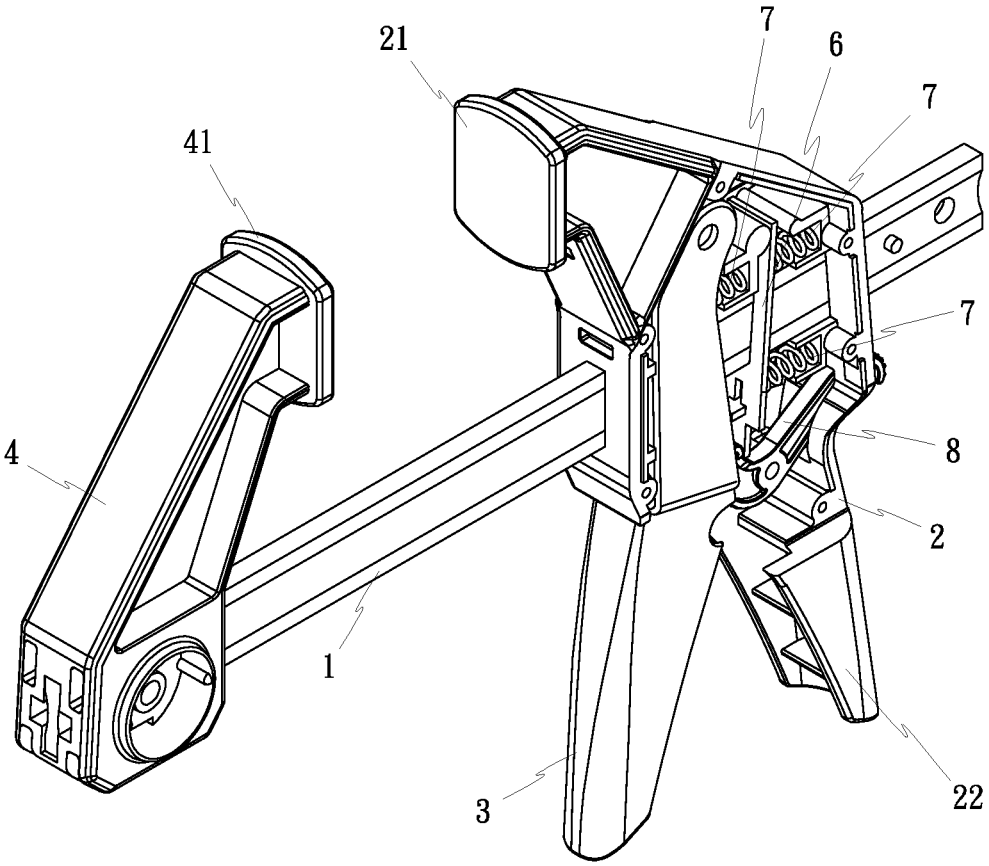
FIG. 1 is an elevational view of a handheld clamping tool in accordance with the present invention.
Figure 2:
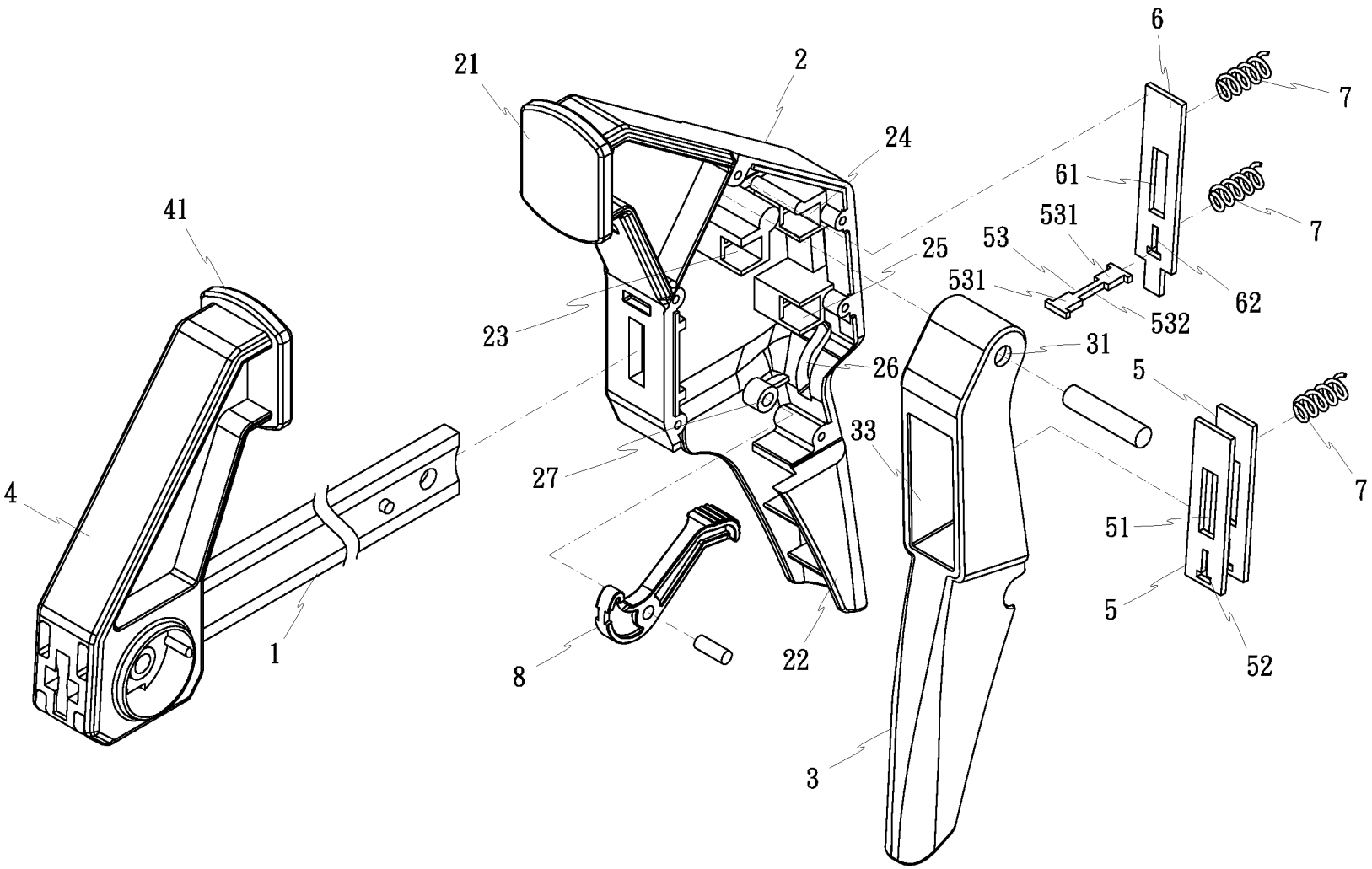
FIG. 2 is an exploded view of the handheld clamping tool in accordance with the present invention.
Figure 3:
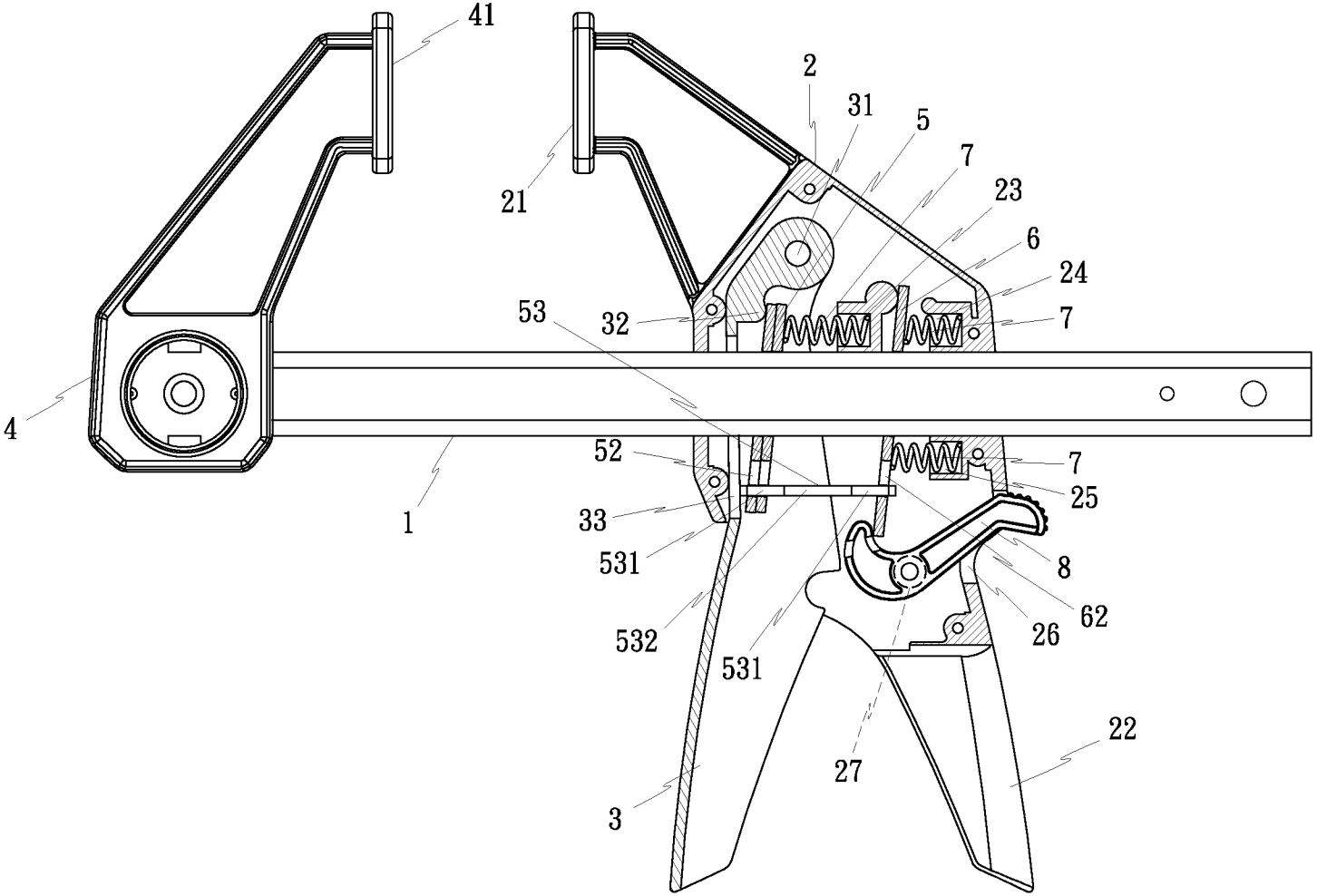
FIG. 3 is a sectional assembly view of the handheld clamping tool in accordance with the present invention.

Referring to FIGS. 1-3, a handheld clamping tool in accordance with the present invention is shown. The handheld clamping tool comprises a sliding bar 1, a fixed handle 2 having installed therein a plurality of actuation plates 5, at least one stop plate 6, spring members 7 and a release bar 8, a driving handle 3, and a first jaw holder 4.

The sliding bar 1 is inserted through the fixed handle 2, the driving handle 3, the first jaw holder 4, the actuation plates 5 and the stop plate 6.

The fixed handle 2 supports the sliding bar 1, comprising a second jaw 21 located on the top end thereof, a grip 22 located on the bottom end thereof, two spring accommodation chambers 23;24 disposed in an inner upper side thereof, a spring accommodation chamber 25 disposed in an inner lower side thereof, a wall hole 26 located on the grip 22, and a pivot hole 27 located on the grip 22 at one lateral side relative to the wall hole 26.

The driving handle 3 is a one piece member, comprising a pivot hole 31 disposed near the top edge thereof for coupling to the fixed handle 2, a cam portion 32 disposed at an inner side thereof near the pivot hole 31 (see FIG. 3), and an opening 33 transversely disposed on a middle part thereof for the passing of the sliding bar 1.

The first jaw holder 4 is fastened to one end of the sliding bar 1 and fixedly holding a first jaw 41 that faces toward the second jaw 21 at the fixed handle 2.

The actuation plates 5 are steel plates, each comprising a through hole 51 for the passing of the sliding bar 1, and a bottom coupling hole 52 coupled to a coupling rod 53. By means of the respective through holes 51, the actuation plates 5 are obliquely coupled to the sliding bar 1 with the respective top ends thereof stopped at the cam portion 32 of the driving handle 3. By means of the cam portion 32, the driving handle 3 can drive the actuation plates 5.

The stop plate 6 is substantially similar to the actuation plates 5, comprising a through hole 61 for the passing of the sliding bar 1, and a bottom coupling hole 62 coupled to the coupling rod 53. Further, the bottom end of the stop plate 6 is stopped against the release bar 8.

The spring members 7 are respectively accommodated in the spring accommodation chambers 23;24;25 and stopped against the actuation plates 5 or stop plate 6.

The release bar 8 is pivotally connected to the pivot hole 27 of the fixed handle 2, having one end thereof extending out of the wall hole 26 of the grip 22 and the other end thereof hooked on the bottom end of the stop plate 6.

Figure 4:
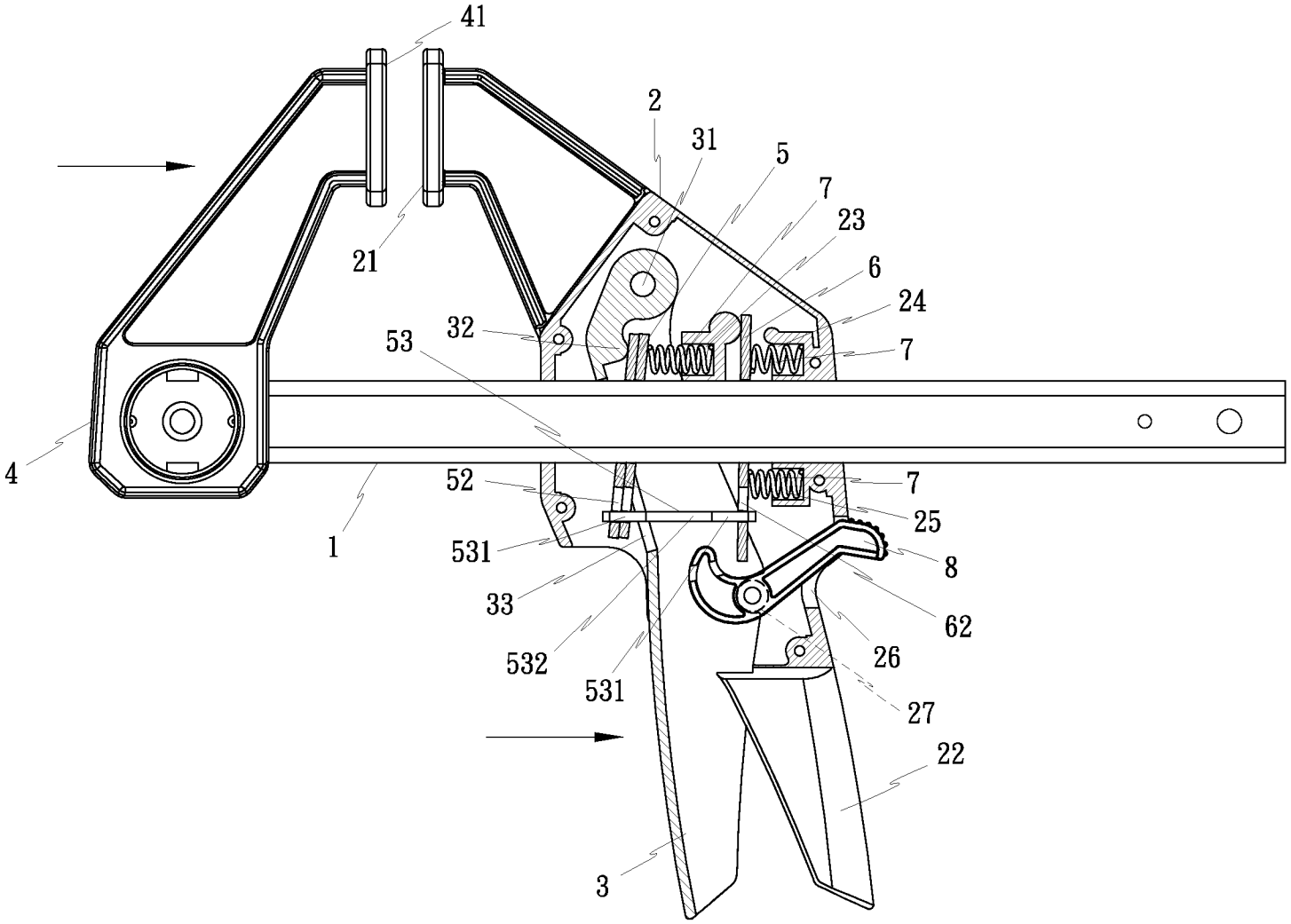
FIG. 4 is a schematic sectional view of the present invention, illustrating the handheld clamping tool in a clamping status.
Figure 5:
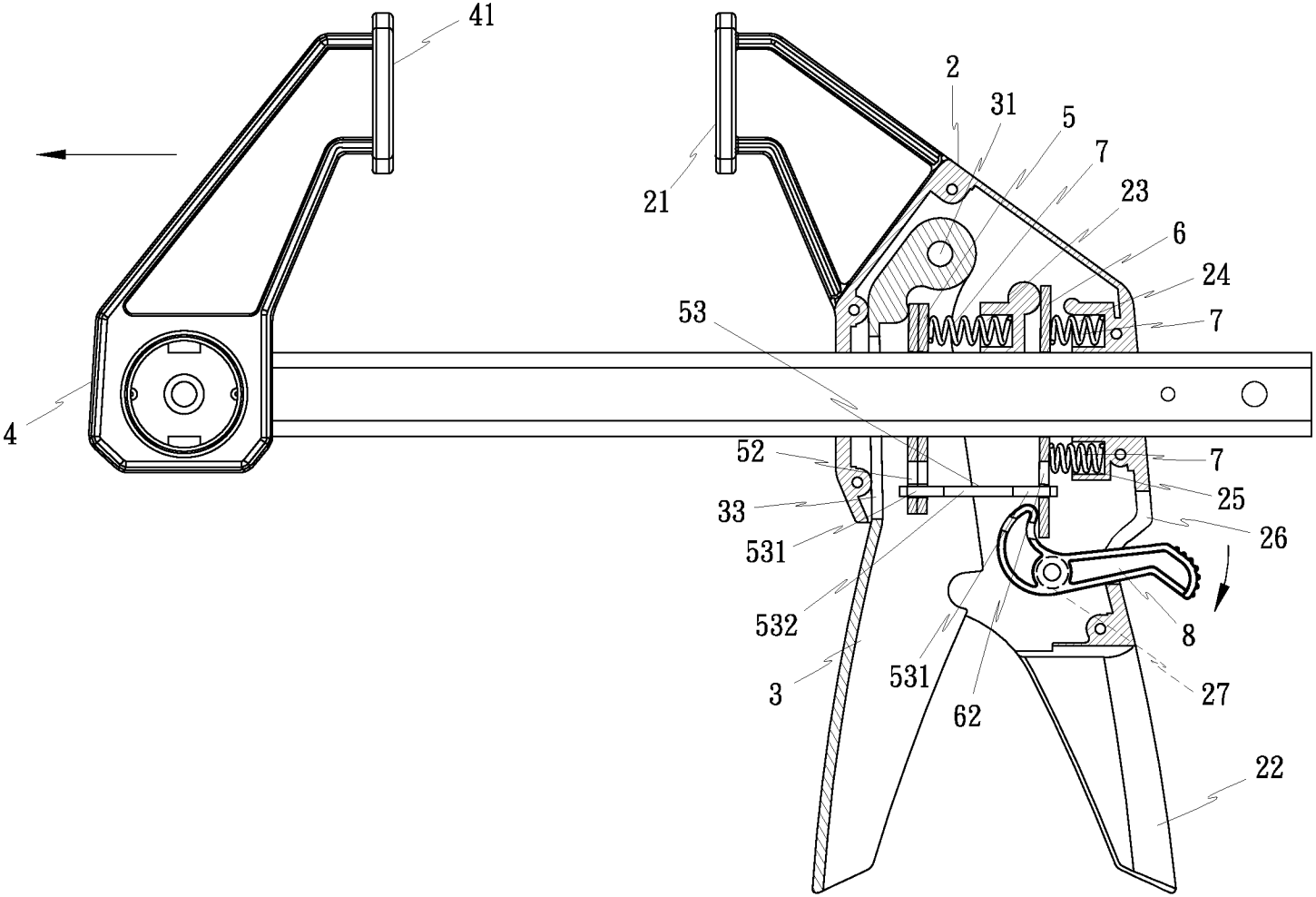
FIG. 5 corresponds to FIG. 4, illustrating the handheld clamping tool released.

When using the handheld clamping tool, press the driving handle 3 to force the cam portion 32 against the actuation plates 5, thereby biasing the actuation plates 5 in different directions and moving the sliding bar 1 into an energy-reserving clamping (or expanded) status (see FIG. 4). When releasing the reserved energy, slightly press the release bar 8 to correct the angular position of the actuation plates 5 and the stop plate 6, thereby disengaging the actuation plates 5 and the stop plate 6 (see FIG. 5), and thus, the handheld clamping tool is returned to its former standby mode.

According to the present invention, the handheld clamping tool simply consists of a limited number of component parts, saving the cost and facilitating installation. By means of the integrated cam portion 32, the driving handle 3 is operable to directly drive the actuation plates 5 and the stop plate 6. Simply using the release bar 8 can control rapid release of the handheld clamping tool. Thus, the handheld clamping tool has the advantages of simple structure and ease of installation.

Further, the aforesaid spring members 7 are compression springs. However, tensile springs or other equivalent members may be used as substitutes.

Further, except the example in which the release bar 8 is mounted at the outer wall of the grip 22. Alternatively, the release bar 8 can be mounted at the inner wall of the grip 22 for triggering by a finger to move the actuation plates 5 or the stop plate 6, achieving the same effect of releasing the handheld clamping tool. Any change of the mounting position or equivalent structural design of the release bar 8 can be made without departing from the spirit and scope of the invention.

According to the present preferred embodiment, the bottom coupling hole 52 of each actuation plate 5 and the bottom coupling hole 62 of the stop plate 6 are inverted "T" holes. Further, the coupling rod 53 is a flat rod having two stepped broad end portions 531 and a narrow elongated neck portion 532 connected between the two stepped broad end portions 531. The coupling rod 53 is inserted through the bottom coupling holes 52 of the actuation plates 5 and the bottom coupling hole 62 of the stop plate 6, and then biased through 90° angle to have the stepped broad end portions 531 be respectively engaged in the respective bottom ends of the bottom coupling holes 52;62. Thus, the coupling rod 53 is prohibited from vertical displacement relative to the actuation plates 5 and the stop plate 6, ensuring normal functioning of the actuation plates 5 and the stop plate 6.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A handheld clamping tool, comprising a sliding bar, a fixed handle having installed therein at least one actuation plate, a stop plate, a plurality of spring members and a release bar, a driving handle, a coupling rod coupling said at least one actuation plate and said stop plate, and a first jaw holder, wherein:

said sliding bar is inserted through said fixed handle, said driving handle, said first jaw holder, said actuation plates and said stop plate;

said fixed handle supports said sliding bar, comprising a second jaw located on a top end thereof and a grip located on a bottom end thereof;

said driving handle is a one piece member, comprising a pivot hole disposed near the top edge thereof and pivotally coupled to said fixed handle, a cam portion disposed at an inner side thereof near said pivot hole, and an opening transversely disposed on a middle part thereof for the passing of said sliding bar;

said first jaw holder is fastened to one end of said sliding bar, comprising a first jaw facing toward said second jaw;

each said actuation plate comprises a through hole for the passing of said sliding bar, a bottom coupling hole coupled to said coupling rod, and a top end stopped at said cam portion of said driving handle;

said stop plate comprises a through hole for the passing of said sliding bar, a bottom coupling hole coupled to said coupling rod, and a bottom end stopped against said release bar;

wherein the coupling holes of said at least one actuation plate and said stop plate are inverted "T" holes each having a vertical slot and a bottom horizontal slot; said coupling rod is a flat rod comprising two stepped broad end portions and an elongated neck portion connected between said two stepped broad end portions, the elongated neck portion being narrower than the two stepped broad end portions, such that each stepped broad end portion is sideways insertable through the vertical slot of the respective coupling hole and when biased by 90° is engaged in the bottom horizontal slot of the respective coupling hole and prevented from moving vertically into the vertical slot; and when pressing said driving handle forces said cam portion against said at least one actuation plate to move said sliding bar into an energy-reserving status; pressing said release bar corrects the angular position of said at least one actuation plate and said stop plate to release the handheld clamping tool, and the handheld clamping tool is returned to the former standby mode.

2. The handheld clamping tool as claimed in claim 1, wherein said fixed handle comprises a plurality of spring accommodation chambers respectively disposed in upper and lower sides of an inside wall thereof; said spring members are respectively accommodated in said spring accommodation chambers and respectively stopped against said at least one actuation plate and said stop plate.

3. The handheld clamping tool as claimed in claim 1, wherein said grip of said fixed handle comprises a wall hole and a pivot hole; said release bar is inserted through said wall hole of said grip of said fixed handle and pivotally connected to the pivot hole of said grip of said fixed handle.

* * * * *